US010683192B2

(12) United States Patent
Michalke et al.

(10) Patent No.: US 10,683,192 B2
(45) Date of Patent: Jun. 16, 2020

(54) MOVING WALKWAY

(71) Applicant: Otis Elevator Company, Farmington, CT (US)

(72) Inventors: Martin Michalke, Brunn am Gebirge (AT); Alexander Turek, Münchendorf (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/247,757

(22) Filed: Jan. 15, 2019

(65) Prior Publication Data

US 2019/0218069 A1 Jul. 18, 2019

(30) Foreign Application Priority Data

Jan. 15, 2018 (EP) ..... 18151576

(51) Int. Cl.

| | |
|---|---|
| ***B66B 21/10*** | (2006.01) |
| ***B66B 23/10*** | (2006.01) |
| ***B66B 23/02*** | (2006.01) |
| ***B66B 23/14*** | (2006.01) |
| ***B66B 23/08*** | (2006.01) |

(52) U.S. Cl.

CPC ..... *B66B 21/10* (2013.01); *B66B 23/024* (2013.01); *B66B 23/026* (2013.01); *B66B 23/08* (2013.01); *B66B 23/10* (2013.01); *B66B 23/145* (2013.01); *B66B 23/147* (2013.01); *B66B 23/14* (2013.01)

(58) Field of Classification Search

CPC ..... B66B 21/10; B66B 23/00; B66B 23/024; B66B 23/10; B66B 23/14; B66B 23/026; B66B 23/08; B66B 23/145; B66B 23/147; B65G 17/065; B65G 17/067; B65G 17/42

See application file for complete search history.

(56) References Cited

U.S. PATENT DOCUMENTS

| | | | | |
|---|---|---|---|---|
| 3,410,390 | A | 11/1968 | Petersen | |
| 4,397,096 | A | 8/1983 | Kraft et al. | |
| 5,470,293 | A | 11/1995 | Schoenenberger | |
| 6,348,025 | B1 | 2/2002 | Schoenenberger | |
| 6,527,099 | B2 | 3/2003 | Ostermeier et al. | |
| 6,540,060 | B1 * | 4/2003 | Fargo | B66B 23/02 198/326 |
| 7,063,202 | B2 | 6/2006 | Ossendorf | |
| 7,219,784 | B2 | 5/2007 | Fargo | |

(Continued)

FOREIGN PATENT DOCUMENTS

| | | |
|---|---|---|
| CN | 1604870 A | 4/2005 |
| CN | 1610643 A | 4/2005 |

(Continued)

OTHER PUBLICATIONS

European Search Report for application EP 18151576.8, dated Sep. 13, 2018, 7 pages.

*Primary Examiner* — Gene O Crawford
*Assistant Examiner* — Keith R Campbell
(74) *Attorney, Agent, or Firm* — Cantor Colburn LLP

(57) ABSTRACT

A moving walkway (1) comprises at least one endless belt (12) moving in a conveyance direction along a closed loop; a plurality of pallets (20); and a plurality of linkages (26*a*, 26*b*) rotatably connecting adjacent pallets (20) with each other. A mounting portion (20*a*) of each pallet (20) is rotatably connected to the at least one belt (12).

18 Claims, 11 Drawing Sheets

(56) References Cited

U.S. PATENT DOCUMENTS

| | | | | |
|---|---|---|---|---|
| 8,931,614 | B2 | 1/2015 | Senger | |
| 10,035,681 | B2 * | 7/2018 | Turek | B66B 7/062 |
| 2006/0266617 | A1 * | 11/2006 | Mustalahti | B65G 17/123 198/321 |
| 2007/0137980 | A1 | 6/2007 | Meyer et al. | |
| 2012/0024675 | A1 | 2/2012 | Spielman | |
| 2016/0176681 | A1 * | 6/2016 | Makovec | B66B 21/10 198/321 |

FOREIGN PATENT DOCUMENTS

| | | | | | |
|---|---|---|---|---|---|
| DE | 1530022 | A1 | | 9/1969 | |
| DE | 1816611 | A1 | * | 7/1970 | B66B 23/02 |
| DE | 1816611 | A1 | | 7/1970 | |
| DE | 20100833 | U1 | | 4/2001 | |
| EP | 1453752 | B1 | | 3/2006 | |
| EP | 1453753 | B1 | | 5/2007 | |
| EP | 1597186 | B1 | | 6/2009 | |
| EP | 1440031 | B1 | | 9/2013 | |
| EP | 3024771 | B1 | | 5/2017 | |
| GB | 392253 | A | | 5/1933 | |
| GB | 510029 | A | * | 7/1939 | B66B 23/02 |
| GB | 510029 | A | | 7/1939 | |
| WO | 03051756 | A1 | | 6/2003 | |

* cited by examiner

MOVING WALKWAY

The invention relates to a moving walkway, in particular to a belt driven moving walkway.

Moving walkways usually comprise a plurality of pallets which are connected to each other by means of at least one chain forming an endless conveyance band moving along an upper conveyance portion and a lower return portion. In turnaround portions established at the ends of the moving walkway the pallets are transferred from the conveyance portion into the return portion and vice versa. Thus, additional space is needed at the ends of the moving walkway for establishing the turnaround portions.

It would be beneficial to provide an improved moving walkway which needs less space without deteriorating the safety of operating the moving walkway.

According to an exemplary embodiment of the invention, a moving walkway comprises at least one endless belt moving in a conveyance direction along a closed loop. The closed loop comprises a conveyance portion and a return portion extending between two turnaround portions, respectively. The moving walkway further comprises a plurality of pallets and a plurality of linkages rotatably connecting adjacent pallets with each other. At least one mounting portion of each pallet is rotatably connected to the at least one belt.

In a moving walkway according to an exemplary embodiment of the invention, using at least one belt for driving the pallets allows reducing the diameters of the turnaround portions. Thus, the space needed for establishing the turnaround portions is reduced. Further, as the pallets are connected to each other by a plurality of linkages independently of the at least one belt, the pallets form an endless conveyance band which remains intact even in case the at least one belt should break. In consequence, the moving walkway may be operated safely as no wide gaps, in which extremities (hands or legs) of passengers could be trapped, will open between adjacent pallets on the running moving walkway even in case the at least one belt should brake.

A number of optional features are set out in the following. These features may be realized in particular embodiments, alone or in combination with any of the other features.

The mounting portions connected to the belts may be first mounting portions and each pallet may comprise at least one additional second mounting portion. The first and second mounting portions are spaced apart from each other in the conveyance direction. Each of the linkages may rotatably connect a first mounting portion of a respective pallet with a second mounting portion of an adjacent pallet. In particular, a first end of each linkage may be rotatably connected to a first mounting portion of an adjacent pallet and to the at least one belt; and a second end of each linkage may be rotatably connected to a second mounting portion of one of the plurality of pallets. Rotatably connecting the mounting portions of the pallets with each other allows guiding the pallets around the turnaround portions having a small diameter without using curved guide rails. It further allows for a smooth rotation initiation (no jerks, lower vibrations) and less overswinging of the pallets beyond the tread level when passing the turnaround portions.

Each linkage may comprise a first linkage element and a second linkage element, respectively, the first linkage elements being spaced apart from the second linkage elements in the lateral direction, i.e. in a direction which is oriented transversely to the conveyance direction. Each pallet may be connected to an adjacent pallet by the first linkage element and the second linkage element. The first and second linkage elements in particular may be located on opposite lateral sides of the belt. Providing a plurality of linkage elements, in particular two linkage elements located on opposite lateral sides of the belt, allows distributing the forces acting on the linkage elements. A symmetric configuration of the linkage elements in particular results in an symmetric distribution of the forces and facilitates a symmetric guidance of the forces.

The moving walkway may comprise first linkage axles extending between first sides of the first and second linkage elements and/or second linkage axles extending between second sides of the first and second linkage elements, respectively. The first linkage axles may be fixed to the at least one belt. Linkage axles extending between the linkage elements allow for a symmetric distribution of the acting forces, in particular driving forces exerted by the belt on the pallets. They further allow effectively connecting the linkage elements to the at least one belt.

The first linkage axles may be fixed to the at least one belt at a position corresponding to the neutral phase of the belt, i.e. a phase of the belt which is neither compressed nor stretched when the at least one belt is bent in the turnaround portions. Fixing the first linkage axles to the neutral phase of the at least one belt avoids generating additional forces in the at least one belt which might fold up the belt.

The at least one belt may be arranged below the pallets in the conveying portion. Similarly, the at least one belt may be arranged above the pallets in the return portion. Arranging the least one belt above/below the pallets allows reducing the space needed in the lateral direction.

The moving walkway may comprise pallet rollers attached to the pallets. The moving walkway may further comprise guide rails configured for guiding and supporting the pallet rollers in order to support the load of the pallets and of passengers standing on the pallets.

The pallet rollers may travel through the turnaround portions without being supported by any guide rails. Such a configuration avoids installing curved guide rails in the turnaround portions. Curved guide rails are more complicated to produce, install and adjust for a noise and vibration less operation and low wearing than straight guide rails. Thus, the fabrication and installation of the moving walkway is simplified when no curved guide rails are used. In an alternative configuration, the pallet rollers may be guided through the turnaround portions by arcuate guide rails, in particular by guide rails extending along a circular arc in order to reduce the forces, in particular centrifugal forces, acting onto the belt.

Each of the pallets may be supported by at least two pallet rollers for distributing the load acting onto the pallet rollers. In such a configuration the at least one belt may be arranged between the at least two pallet rollers. This allows for easy access to the rollers and results in a high tilt stability, in particular when passengers stand on the lateral side portions of the pallets. It further enhances the directional stability of the movement of the pallets in the lateral direction.

The moving walkway may comprise at least two belts extending parallel to each other, wherein each pallet is connected to each of the belts. Employing a plurality of belts reduces the forces acting on each of the belts. It further provides redundancy so that the moving walkway may be operated at least in an emergency operation mode, e.g. with reduced speed, in case one of the belts should break.

In such a configuration the pallet rollers may be arranged between the at least two belts. The least two pallet rollers in particular may be arranged coaxially with each other. In a configuration in which the pallet rollers are arranged coaxially between the belts, a common axle may be used for supporting at the least two pallet rollers. Further, in such a configuration, a high stiffness/rigidity may be achieved without increasing the weight of the pallets.

In the following exemplary embodiments of the invention are described with reference to the enclosed figures.

FIG. 1 schematically depicts a side view of a moving walkway.

FIG. 2 schematically depicts a side view of a portion of a conveyance band of a moving walkway according to an exemplary embodiment of the invention.

FIG. 3 schematically depicts a perspective view of a straight portion of the conveyance band according to an exemplary embodiment of the invention.

FIG. 4 schematically depicts a side view of a portion of the conveyance band in a turnaround portion according to an exemplary embodiment of the invention.

FIG. 5 schematically depicts a perspective view of a portion of the conveyance band in a turnaround portion according to an exemplary embodiment of the invention.

Figure 7:
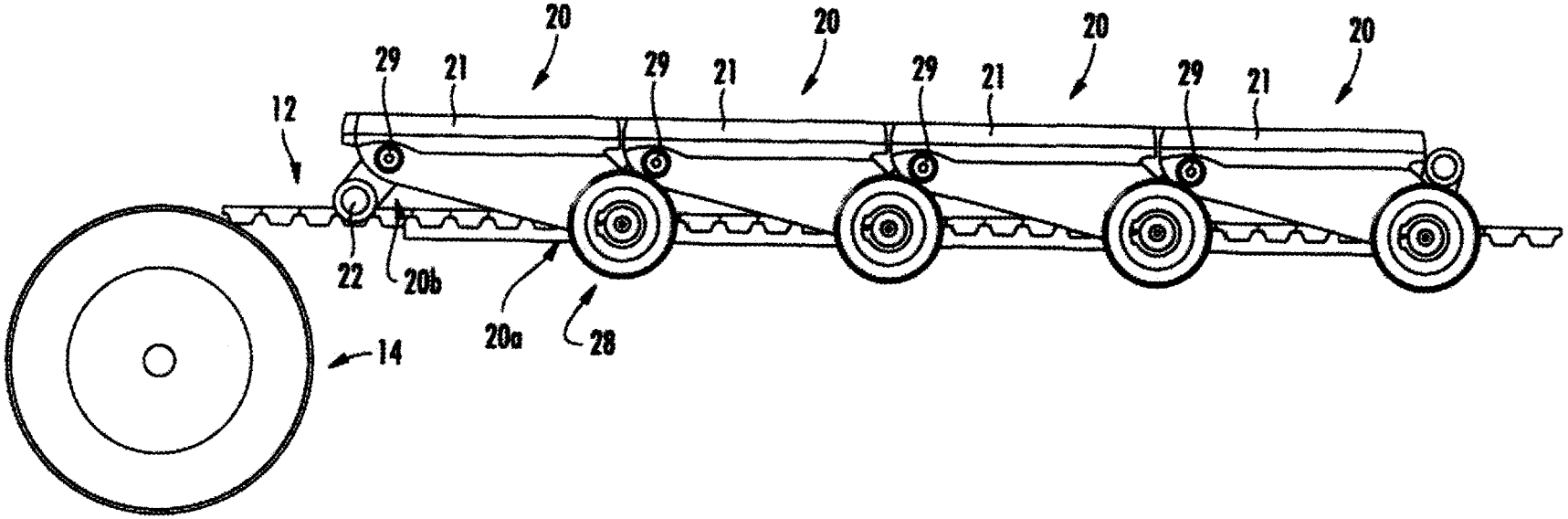

FIG. 7 schematically depicts a side view of a portion of the conveyance band according to another exemplary embodiment of the invention.

Figure 8:
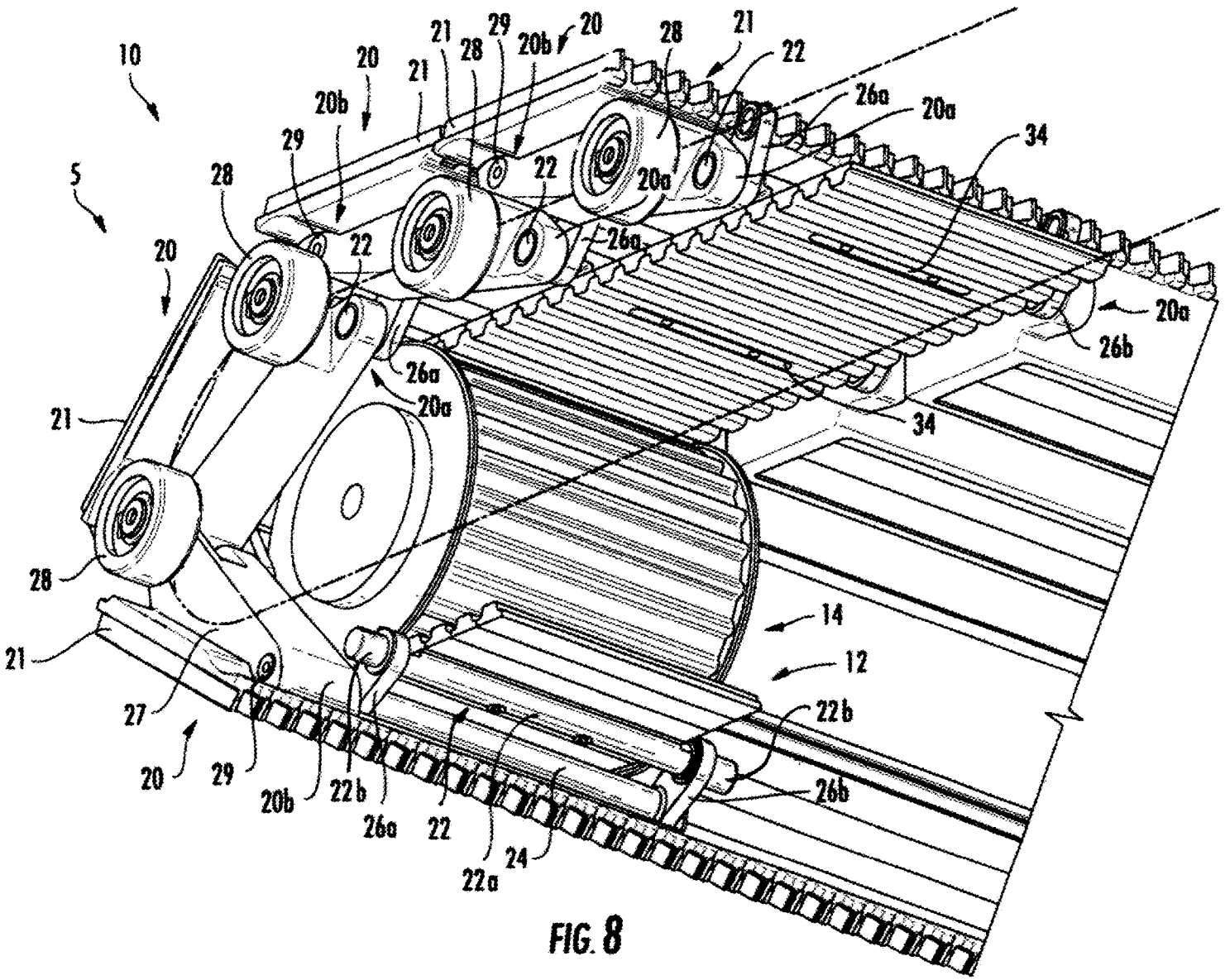

FIG. 8 schematically depicts a perspective view of a portion of the conveyance band shown in FIG. 7 in a turnaround portion.

Figure 9:
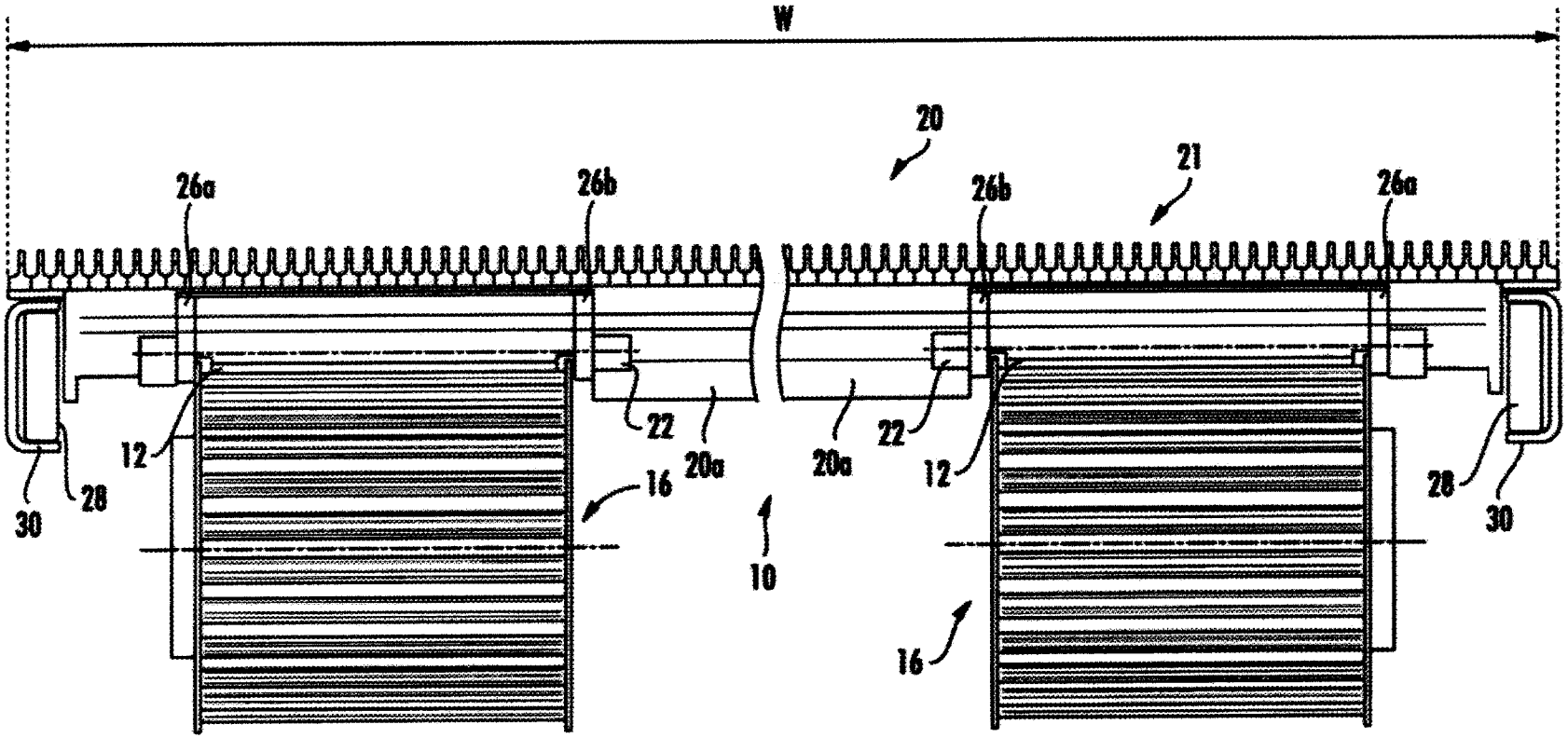

FIG. 9 shows a sectional view through the conveyance band shown in FIGS. 7 and 8.

Figure 1:
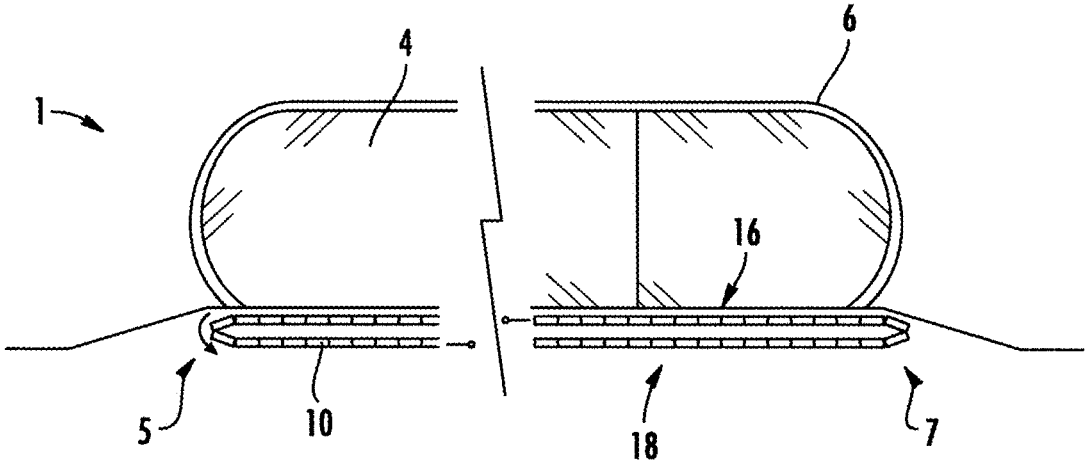

FIG. 1 schematically depicts a schematic side view of a moving walkway 1.

The moving walkway 1 comprises an endless conveyance band 10 moving along an upper conveyance portion 16 and a lower return portion 18. Turnaround portions 5, 7, are provided at both ends of the moving walkway 1. In the turnaround portions 5, 7 the conveyance band 10 passes from the conveyance portion 16 into the return portion 18, and vice versa.

Optionally balustrades 4 supporting moving handrails 6 extend parallel to the conveyance portion 16.

Figure 2:
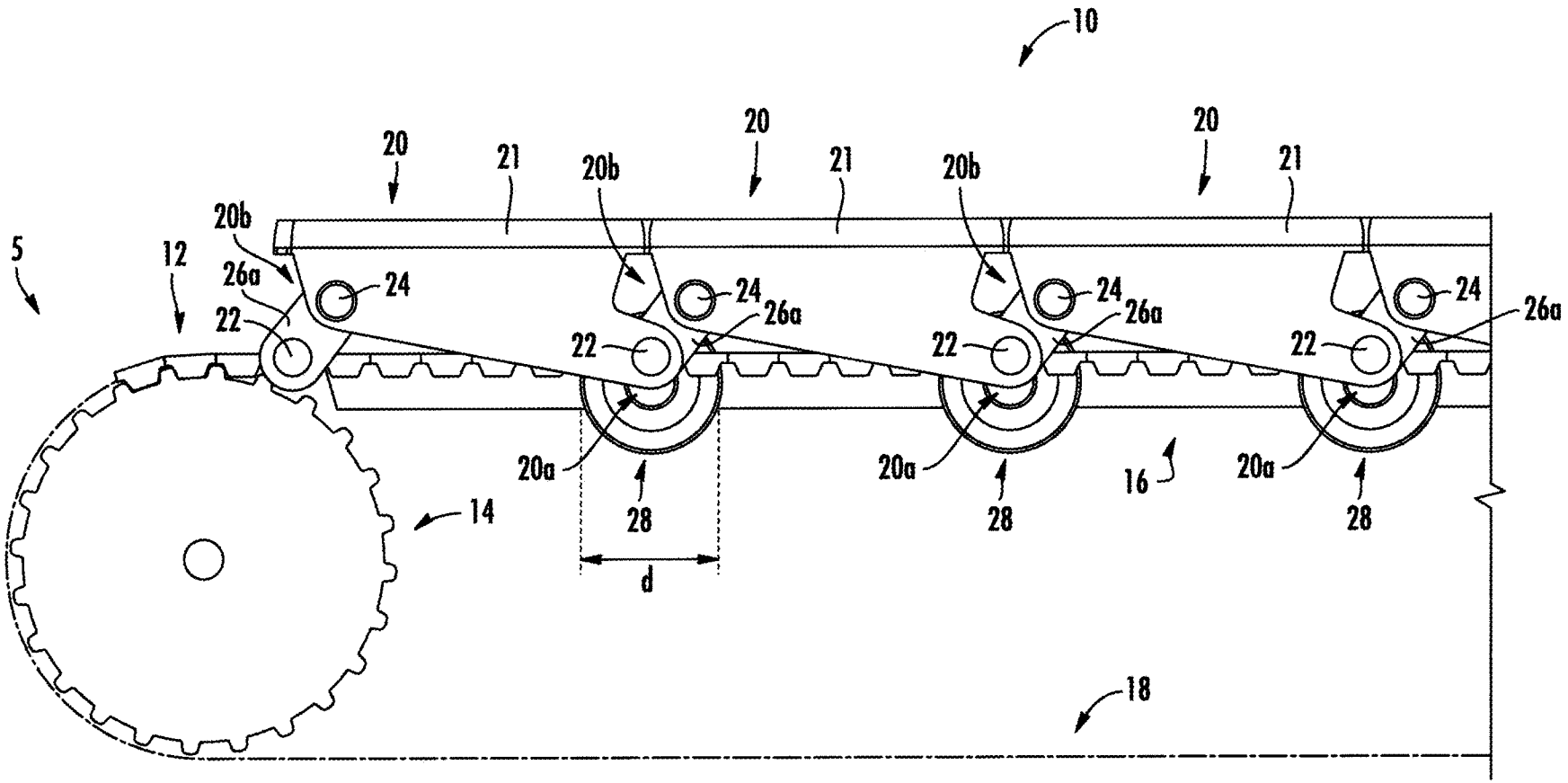
Figure 3:
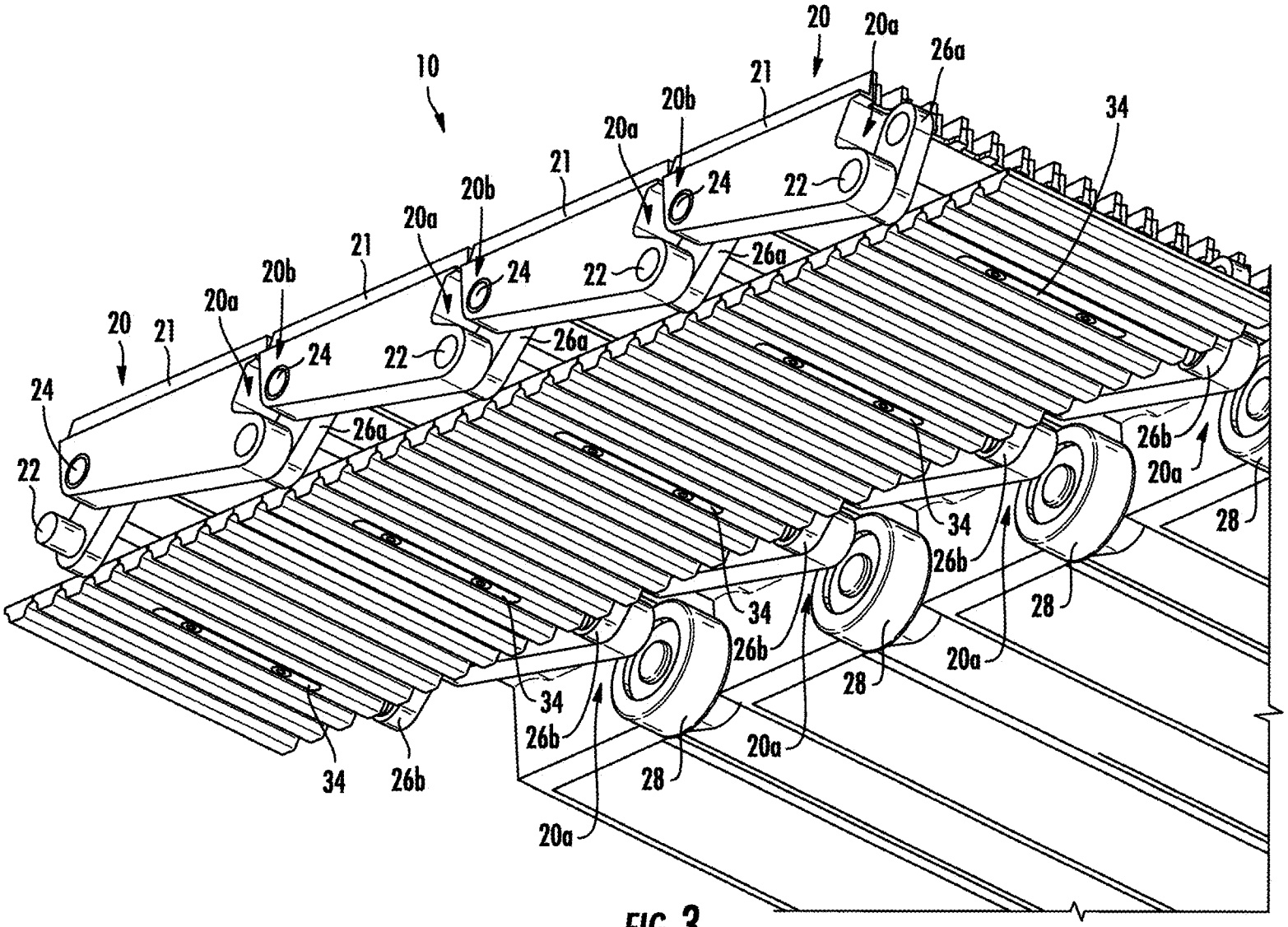

FIG. 2 schematically depicts a side view of a portion of the conveyance band 10 of a moving walkway 1 according to an exemplary embodiment of the invention, in particular a portion next to a turnaround portion 5. FIG. 3 shows a perspective view of the straight portion of the conveyance band 10 shown in FIG. 2.

Figure 4:
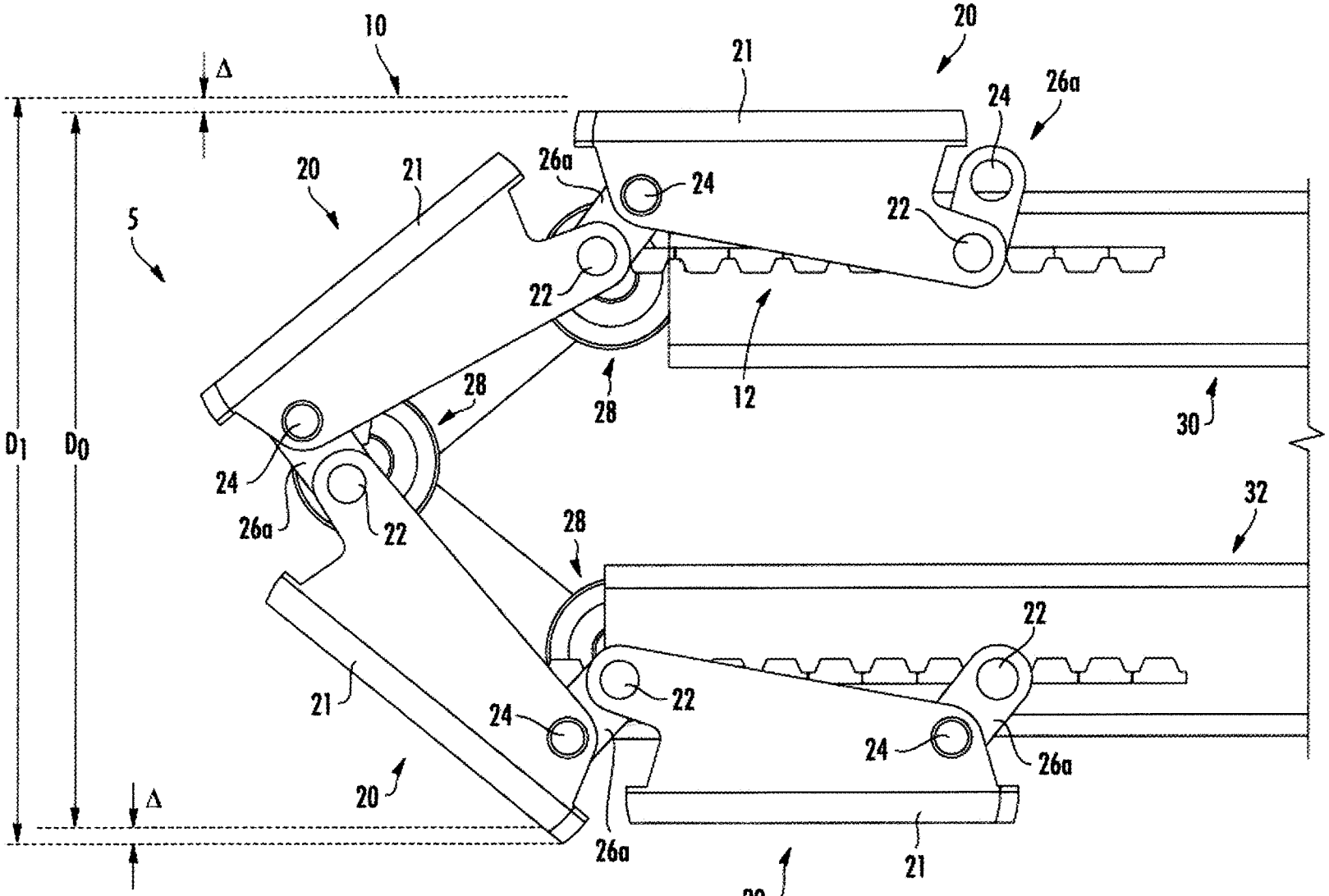
Figure 5:
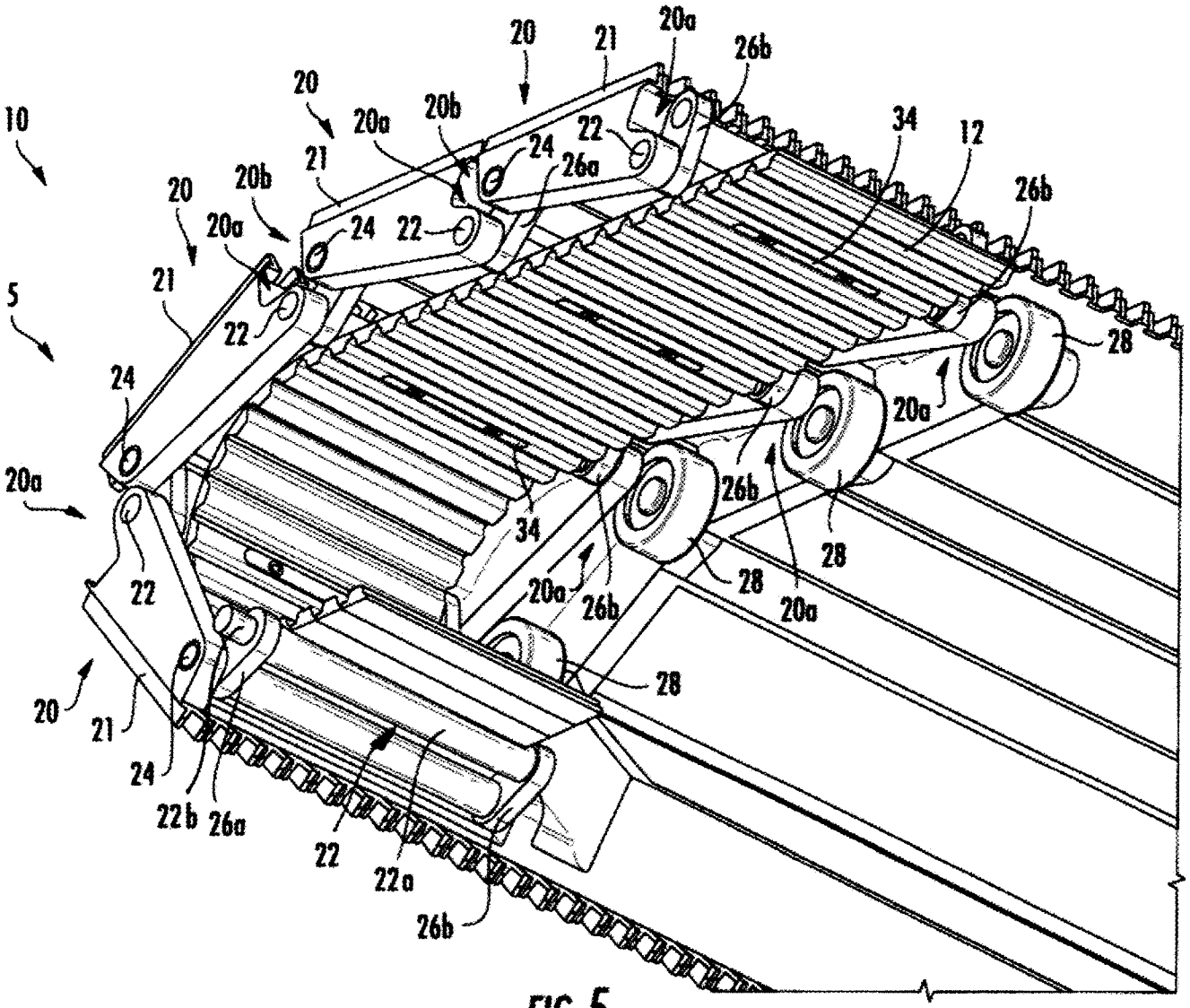

FIG. 4 shows a side view of a portion of the conveyance band 10 within the turnaround portion 5 and FIG. 5 shows a perspective view thereof.

The conveyance band 10 comprises a toothed belt 12 extending in a conveyance direction along the upper conveyance portion 16 and the lower return portion 18. In FIG. 2 the belt 12 is depicted only schematically in the return portion 18. In the turnaround portion 5 the teeth of the belt 12 engage with a sprocket 14, which is configured for transferring the belt 12 from the conveyance portion 16 into the return portion 18, and/or vice versa. The belt may have a width of 100 mm to 200 mm, in particular a width of 125 mm to 175 mm, more particularly a width of 150 mm in the lateral direction.

A similar sprocket 14 (not shown) is provided in the other turnaround portion 7 of the moving walkway 1 (cf. FIG. 1), which is not shown in FIGS. 2 to 5. At least one of the sprockets 14 is driven by a drive mechanism (not shown) for driving the belt 12. In an alternative embodiment, a diverter wheel (not shown) may be used instead of a second sprocket 14.

The conveyance band 10 further comprises a plurality of pallets 20 attached to the belt 12. For clarity of the illustration only some of the pallets 20 are shown in FIGS. 2 to 5, respectively. Each of the pallets 20 comprises a tread plate 21 for supporting passengers using the moving walkway 1.

Each pallet 20 has at least one first mounting portion 20*a*, which is shown on the right side of the pallets 20 in FIGS. 2 to 5, and at least one second mounting portion 20*b*, which is shown on the left side of the pallets 20 in FIGS. 2 to 5. The first and second mounting portions 20*a*, 20*b* are spaced apart from each other in the conveyance direction.

The first and second mounting portions 20*a*, 20*b* are also spaced apart from each other in a vertical direction when the pallets 20 are located in the conveyance portion 16 or in the return portion 18. In other words, the first and second mounting portions 20*a*, 20*b* are arranged at different heights when the pallets 20 are located in the conveyance portion 16 or in the return portion 18.

Each pallet 20 comprises a first mounting portion 20*a* and a second mounting portion 20*b* on each lateral side of the belt 12, respectively (cf. FIGS. 3 and 5).

The first mounting portions 20*a* of each pallet 20 are rotatably connected to the belt 12 by first linkage axles 22 extending between the first mounting portions 20*a* and the belt 12.

Figure 6:
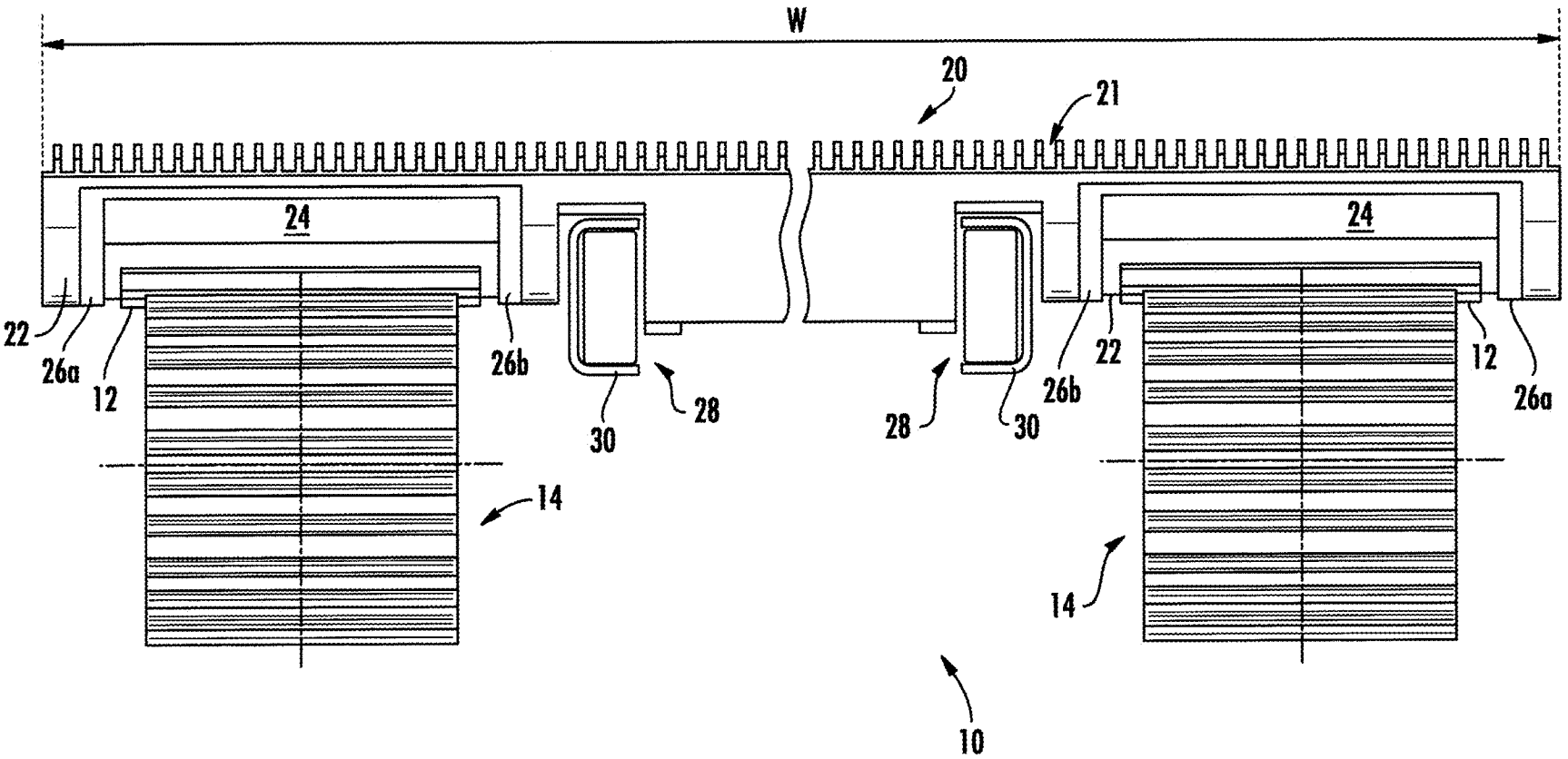
FIG. 6 shows a sectional view though the conveyance band according to an exemplary embodiment of the invention.
Figure 6A:
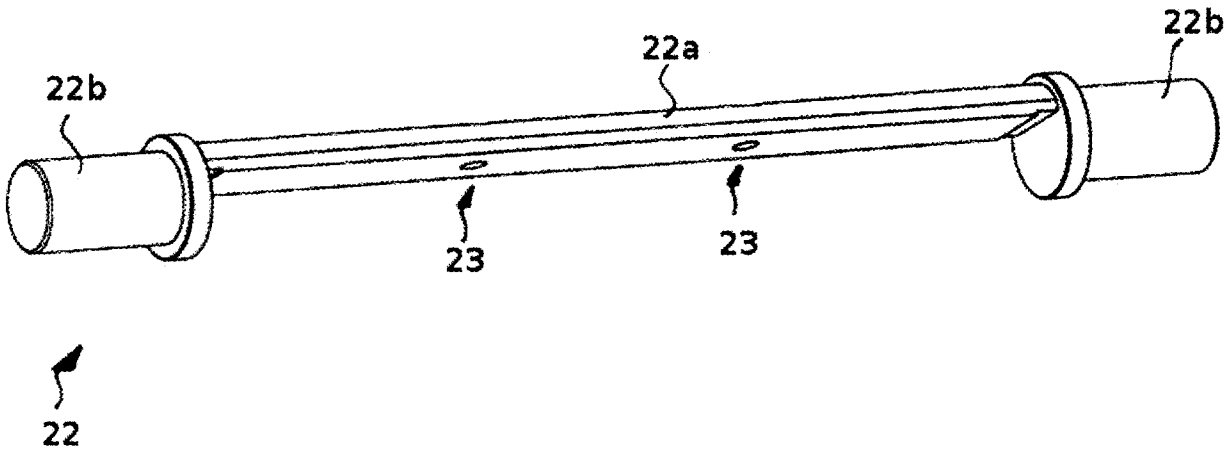
FIG. 6A shows a perspective view of a first linkage axle according to an exemplary embodiment of the invention.
Figure 6B:
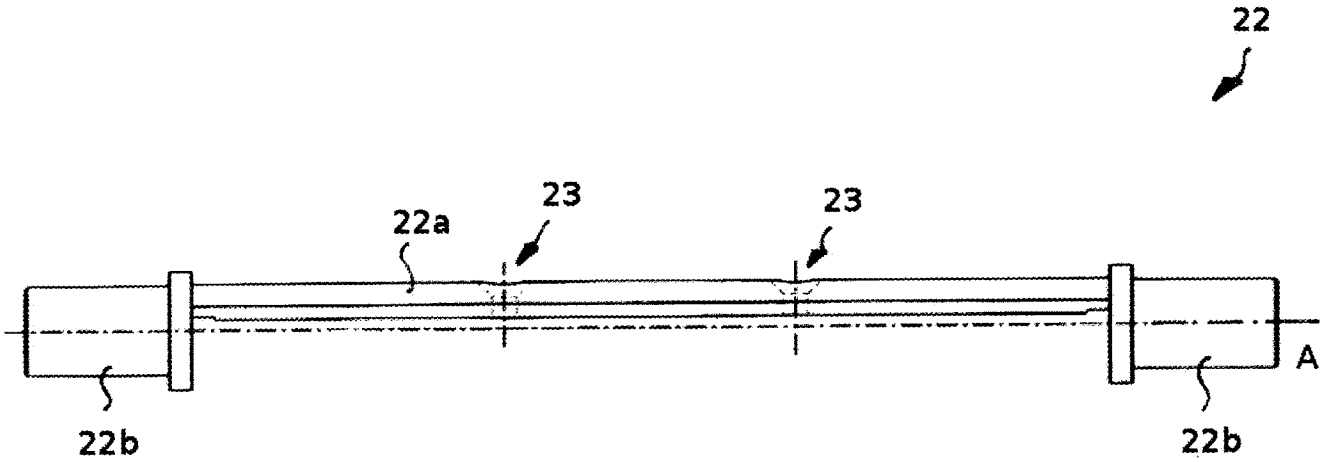
FIG. 6B shows a side view thereof.

FIG. 6A shows a perspective view of a first linkage axle 22 according to an exemplary embodiment of the invention and FIG. 6B shows a side view thereof. Each first linkage axle 22 is formed as a U-shaped bracket comprising a central portion 22*a* extending along the non-toothed side of the belt 12 when the first linkage axle 22 is mounted to the belt 12, and two lateral cylindrical extensions or stubs 22*b* laterally extending from both ends of the central portion 22*a*. The cylindrical extensions or stubs 22*b* are arranged coaxially with each other along a common axis A.

For mounting a first linkage axle 22 to the belt 12, the central portion 22*a* is arranged along the non-toothed side of the belt 12 and the first linkage axle 22 is fixed to the belt 12 by means of screws or bolts (not shown) extending though openings 23 formed in the central portion 22*a* and a mounting element 34 provided at the opposite, toothed side of the belt 12 (see FIGS. 3 and 5).

The first linkage axles 22 in particular are designed so that the common axis A of the extensions or stubs 22*b* extends through a neutral phase of the belt 12, i.e. a portion of the belt 12 which is neither compressed nor stretched when the belt 12 is bent in the turnaround portions 5, 7 for being guided around the sprocket 14.

First linkage axles 22 may be mounted at every 7th tooth of the belt 12.

In addition to the first mounting portions 20*a* of a pallet 20, a linkage 26*a*, 26*b* including two linkage elements 26*a*, 26*b* is rotatably connected to each first linkage axle 22. In particular, a first linkage element 26*a* of the linkage 26*a*, 26*b* is arranged on a first lateral side of the belt 12, and a second linkage element 26*b* of the linkage 26*a*, 26*b* is arranged on a second lateral side of the belt 12. Thus, each linkage element 26*a*, 26*b* is sandwiched between the belt 12 and a first mounting portion 20*a* of a pallet 20. Each linkage element 26*a*, 26*b* is formed as a bar comprising a first end and an opposing second end. Each first linkage axle 22 extends through an opening formed next to the first end of each linkage element 26*a*, 26*b*, respectively.

As a result, the first linkage axles 22 rotatably connect each linkage element 26*a*, 26*b* to the belt 12 and to a first mounting portion 20*a* of one of the pallets 20, respectively.

A second linkage axle 24 extends between the second mounting portion 20*b* of an adjacent pallet 20 through the second end of each linkage element 26*a*, 26*b*. As one linkage element 26*a*, 26*b* is arranged on each lateral side of the pallet 20, two adjacent pallets 20 are connected to each other by two linkage elements 26*a*, 26*b*, respectively. The linkage elements 26*a*, 26*b* are pivotably connected with respect to each of the two adjacent pallets 20. This allows changing the distance between the two pallets in the conveyance direction in the turnaround sections by pivoting the linkage elements 26*a*, 26*b* with respect to the pallets 20.

The linkage elements 26*a*, 26*b* connect the pallets 20 with each other independently of the belt 12, thus forming an endless chain of pallets 20 without the aid of the belt 12. In consequence, the chain of pallets 20 remains intact even in case the belt 12 should brake.

Each pallet 20 further is equipped with at least one pallet roller 28 rotatably attached to the respective pallet 20. The pallet rollers 28 are guided by straight guide rails 30, 32 in the conveyance portion 16 and in the return portion 18, respectively (see FIG. 4). The pallet rollers 28 may have a diameter d of 25 mm to 100 mm, in particular a diameter d of 55 mm. The width of the pallet rollers 28 in the lateral direction may be in between 20 mm and 25 mm. The pallet rollers 28 in particular may have a width of 22 mm in the lateral direction.

The guide rails 30, 32 do not extend into the turnaround portions 5, 7, at least not to such an extent as to guide the pallet rollers 28 around the turnaround portions 5, 7.

Thus, in the turnaround portions 5, 7 the conveyance band 10 is guided only by the engagement of the belt 12 with the respective sprocket 14. The moving walkway 1 in particular does not comprise curved guide rails for guiding the pallet rollers 28 around the curved turnaround portions 5, 7. Not employing any curved guide rails facilitates the installation of the moving walkway 1, as no curved guide rails, which are more difficult to handle than straight guide rails, need be manufactured, transported and installed and aligned. Guiding the rollers 30 along curved guide rails further would generate additional noise during operation.

The additional degree of freedom provided by the rotatably mounted linkage elements 26*a*, 26*b* allows for a desirable small diameter of the turnaround portions 5, 7.

In an exemplary configuration, in which the vertical distance Do between the tread plates 21 of the pallets 20 in the conveyance portion 16 and the tread plates 21 of the pallets 20 in the return portion 18 is $D_0$=253 mm, the maximum vertical distance $D_1$ between the tread plates 21 of the pallets 20 in the turnaround portions 5, 7 increases only by a few millimeters, e.g. by $\Delta$=3 mm on each side up to $D_1$=259 mm (see FIG. 4). FIG. 6 shows a sectional view through the conveyance band 10 in the conveyance portion 16 in a plane which is oriented orthogonally to the conveyance direction, i.e. the conveyance band 10 travels in the conveyance direction perpendicularly to the plane of FIG. 6.

FIG. 6 illustrates that each pallet 20 is connected to two belts 12 extending parallel to each other in the conveyance direction (perpendicularly to the plane of view). In the turnaround portions 5, 7, each of the belts 12 is in engagement with and guided by an associated sprocket 14. Each belt 12 is connected to the pallets 20 by two linkage elements 26*a*, 26*b* as it has been described before.

Two pallet rollers 28 are rotatably connected to each pallet 20. The pallet rollers 28 are guided by respectively associated straight guide rails 30. The belts 12, the linkage elements 26*a*, 26*b* and the pallet rollers 28 are arranged under the pallets 20. Hence, no parts of the conveyance band 10 extend beyond the pallets 20 in the lateral direction and thus the dimension of the conveyance band 10 in the lateral direction is defined by the width W of the pallets 20, which may be up to e.g. 1400 mm. In the embodiment shown in FIGS. 2 to 6, the pallet rollers 28 are arranged between the two belts 20 in the lateral direction.

Arranging the belts 12, the linkage elements 26*a*, 26*b* and the pallet rollers 28 under the pallets 20 in the conveyance portion 16 and above the pallets 20 in the return portion 18 (cf. FIG. 4) allows reducing the total width of the conveyance band 10 compared to a configuration in which the belts 12, the linkage elements 26*a*, 26*b* and/or the pallet rollers 28 are arranged laterally to the pallets 20.

FIGS. 7 to 9 correspond to FIGS. 2, 5 and 6, respectively, depicting another exemplary embodiment of the invention. In said alternative embodiment, the pallet rollers 28 are arranged laterally outside the two belts 12 extending parallel to each other.

With respect to the other features, in particular with respect to the connection of the pallets 20 to the belts 12 by means of the linkage elements 26*a*, 26*b*, the exemplary embodiment shown in FIGS. 7 to 9 is very similar to the embodiment shown in FIGS. 2 to 6, which has been described in detail before. Thus, the identical features are not discussed in detail again, but reference is made to the previous description. The second linkage axles 24 are fixed to the second mounting portions 20*b* be means of screws 29 depicted in FIG. 7.

Although arranged laterally outside the two parallel belts 12, the pallet rollers 28 are still arranged below or above the pallets 12 in this embodiment as well. Thus, as illustrated in FIG. 9, also in this embodiment the width of the conveyance band 10 may be reduced basically to the width W of the pallets 20. Although the exemplary embodiments illustrated in the figures comprise two belts 12 extending parallel to each other, the skilled person will understand that the principles of the invention may be applied equally to moving walkways 1 comprising only one belt 12 or more than two belts 12.

Similarly, more than two pallet rollers 28 may be attached to each of the pallets 20 in order to reduce the load acting on each of the pallet rollers 28.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention include all embodiments falling within the scope of the claims.

REFERENCES

1 moving walkway
4 balustrade
5 turnaround portion
6 handrail
7 turnaround portion
10 conveyance band
12 belt
14 sprocket

16 conveyance portion
18 return portion
20 pallet
20*a* first mounting portion
20*b* second mounting portion
21 tread plate
22 first linkage axle
22*a* central portion
22*b* extension or stub
23 opening
24 second linkage axle
26*a*, 26*b* linkage/first and second linkage elements
28 pallet rollers
29 screw
30, 32 guide rails
34 mounting element
d diameter of the pallet rollers
$D_0$ vertical distance between the tread plates of the pallets in the conveyance portion and the return portion
$D_1$ maximum vertical distance of the tread plates of the pallets in the turnaround portions
Δ difference between $D_1$ and $D_0$
W width of the pallets

What is claimed is:

1. Moving walkway comprising:
at least one endless belt moving in a conveyance direction along a closed loop, the closed loop comprising a conveyance portion and a return portion extending between two turnaround portions, respectively;
a plurality of pallets; and
a plurality of linkages rotatably connecting adjacent pallets with each other;
wherein at least one mounting portion of each pallet is rotatably connected to the at least one belt.

2. Moving walkway according to claim 1,
wherein the mounting portions connected to the at least one belt are first mounting portions and each pallet further comprises a second mounting portion, the first and second mounting portions being spaced apart from each other along the conveyance direction; and
wherein each of the linkages rotatably connects the first mounting portion of a respective pallet with the second mounting portion of an adjacent pallet.

3. Moving walkway according to claim 1, wherein
a first end of each linkage is rotatably connected to a first mounting portion of one of the plurality of pallets and to the at least one belt; and
a second end of each linkage is rotatably connected to a second mounting portion of an adjacent pallet.

4. Moving walkway according to claim 1, wherein each of the linkages comprises a first linkage element and a second linkage element,
wherein the first linkage elements are spaced apart from the second linkage elements in the lateral direction.

5. Moving walkway according to claim 4, further comprising first linkage axles extending between first sides of the first and second linkage elements.

6. Moving walkway according to claim 5, wherein the linkage axles are fixed to the at least one belt at a position corresponding to the neutral phase of the at least one belt which is neither compressed nor stretched when the belt is bent.

7. Moving walkway according to claim 5, further comprising second linkage axles extending between second sides of the first and second linkage elements.

8. Moving walkway according to claim 1, wherein the at least one belt is arranged below the pallets, when the pallets are located in the conveyance portion.

9. Moving walkway according to claim 1, further comprising
pallet rollers attached to the pallets and
guide rails configured for guiding and supporting the pallet rollers.

10. Moving walkway according to claim 9, wherein the pallet rollers are configured to travel along the turnaround portions without being supported by any guide rails.

11. Moving walkway according to claim 9, wherein each of the pallets is equipped with at least two pallet rollers.

12. Moving walkway according to claim 11, wherein the least two pallet rollers are arranged coaxially with each other.

13. Moving walkway according to claim 11, wherein the at least one belt is arranged between the at least two pallet rollers.

14. Moving walkway according to claim 1 comprising at least two belts extending parallel to each other, wherein each pallet is connected to each of the belts.

15. Moving walkway according to claim 14, wherein pallet rollers are arranged between the at least two belts.

16. Moving walkway according to claim 4, wherein the first and second linkage elements are located on opposite lateral sides of the belt.

17. Moving walkway according to claim 5, wherein the first linkage axles are fixed to the at least one belt.

18. Moving walkway comprising:
at least one endless belt moving in a conveyance direction along a closed loop, the closed loop comprising a conveyance portion and a return portion extending between two turnaround portions, respectively;
a plurality of pallets; and
a plurality of linkages rotatably connecting adjacent pallets with each other;
wherein at least one mounting portion of each pallet is rotatably connected to the at least one belt;
wherein each of the linkages comprises a first linkage element and a second linkage element, wherein the first linkage elements are spaced apart from the second linkage elements in the lateral direction;
a first linkage axle extending between the first and second linkage elements;
the first linkage axle fixed to the belt by a fastener extending through an opening formed in a central portion of the first linkage axle and through a mounting element provided at an opposite, toothed side of the belt.

* * * * *